US008857478B2

(12) United States Patent
Klarl et al.

(10) Patent No.: US 8,857,478 B2
(45) Date of Patent: Oct. 14, 2014

(54) APPARATUS FOR TREATING CONTAINERS HAVING A HEIGHT-ADJUSTABLE ISOLATOR

(75) Inventors: Hermann Klarl, Thalmassing (DE); Roland Laumer, Regensburg (DE)

(73) Assignee: Krones AG, Neutraubling (DE)

( * ) Notice: Subject to any disclaimer, the term of this patent is extended or adjusted under 35 U.S.C. 154(b) by 1 day.

(21) Appl. No.: 13/072,669

(22) Filed: Mar. 25, 2011

(65) Prior Publication Data

US 2011/0232233 A1 Sep. 29, 2011

(30) Foreign Application Priority Data

Mar. 26, 2010 (DE) ..... 10 2010 013 132

(51) Int. Cl.

*B67C 3/00* (2006.01)
*B67C 7/00* (2006.01)
*B67C 3/22* (2006.01)

(52) U.S. Cl.

CPC ..... *B67C 3/22* (2013.01); *B67C 2003/228* (2013.01); *B67C 3/004* (2013.01); *B67C 7/0073* (2013.01)

USPC ..... 141/152; 141/85; 141/89; 141/144; 141/145; 53/425

(58) Field of Classification Search

USPC ..... 141/85, 89, 92, 145, 283; 53/136.1, 53/282, 283, 425

See application file for complete search history.

(56) References Cited

U.S. PATENT DOCUMENTS 3,101,752 A * 8/1963 Martin ..... 141/92
3,757,622 A * 9/1973 Berry ..... 83/165

(Continued)

FOREIGN PATENT DOCUMENTS

CN 1732122 2/2007
CN 101024477 8/2007

(Continued)

OTHER PUBLICATIONS

Chinese Office Action dated Aug. 31, 2012, issued in corresponding Chinese Patent Application No. 2011100734675.

(Continued)

*Primary Examiner* — Timothy L Maust

(74) *Attorney, Agent, or Firm* — Novak Druce Connolly Bove + Quigg *LLP*

(57) ABSTRACT

An apparatus for treating containers may include a treatment chamber in which the containers are treated, and a conveyor unit which transports the containers within the treatment chamber. The treatment chamber can be isolated by means of at least one wall from an environment external of the treatment chamber in such a way that sterile conditions can be achieved in the treatment chamber, and by means of at least one treatment unit which treats the containers within the treatment chamber. At least one wall of the treatment chamber is arranged to be movable. A sealing assembly seals the treatment chamber in an area with regard to elements of the apparatus, which are movable relative to each other, against the environment external of the treatment chamber. The sealing assembly includes a surrounding channel, into which a liquid sealing agent can be introduced, as well as a secondary wall which is arranged within the channel at least in sections. The secondary wall is movable relative to the channel in the circumferential direction of the channel, and the secondary wall is movable in a direction that is perpendicular to the circumferential direction.

20 Claims, 4 Drawing Sheets

(56) References Cited

U.S. PATENT DOCUMENTS

| | | | | |
|---|---|---|---|---|
| 3,799,220 | A * | 3/1974 | Berry et al. | 141/46 |
| 4,489,769 | A * | 12/1984 | Catelli | 141/91 |
| 6,082,418 | A * | 7/2000 | Naecker et al. | 141/145 |
| 6,799,612 | B2 * | 10/2004 | Stewart et al. | 141/181 |
| 7,341,079 | B2 * | 3/2008 | Zanga | 141/92 |
| 8,337,772 | B2 * | 12/2012 | Laumer et al. | 422/302 |
| 8,375,683 | B2 * | 2/2013 | Knieling et al. | 53/317 |
| 2006/0059862 | A1 | 3/2006 | Zanga | |
| 2007/0012377 | A1 | 1/2007 | Popplau | |
| 2007/0193222 | A1 | 8/2007 | Till et al. | |
| 2007/0204562 | A1 | 9/2007 | Till et al. | |
| 2009/0223168 | A1 * | 9/2009 | Zanini et al. | 53/281 |
| 2010/0037984 | A1 * | 2/2010 | Hiroya et al. | 141/59 |
| 2010/0266467 | A1 | 10/2010 | Laumer et al. | |

FOREIGN PATENT DOCUMENTS

| | | | |
|---|---|---|---|
| DE | 2 139 057 | | 2/1972 |
| DE | 10 2006 007 481 | B3 | 7/2007 |
| DE | 10 2006 007 367 | A1 | 8/2007 |
| DE | 603 11 011 | T2 | 8/2007 |
| DE | 10 2007 047 259 | A1 | 4/2009 |
| GB | 628530 | | 8/1949 |
| WO | 2005/056465 | A1 | 6/2005 |
| WO | 2007/132339 | A1 | 11/2007 |
| WO | 2009/130656 | A1 | 10/2009 |

OTHER PUBLICATIONS

European Office Action dated Aug. 1, 2012, issued in corresponding European Patent Application No. 11 159 312.5.

* cited by examiner

APPARATUS FOR TREATING CONTAINERS HAVING A HEIGHT-ADJUSTABLE ISOLATOR

CROSS-REFERENCE TO RELATED APPLICATION

This application claims the benefit of priority of German Patent Application No. 10 2010 013 132.6, filed Mar. 26, 2010, pursuant to 35 U.S.C. 119(a)-(d), the disclosure of which is incorporated herein by reference.

TECHNICAL FIELD

The present disclosure relates to an apparatus for treating containers and, more particularly, to an apparatus for treating containers having a height-adjustable isolator.

BACKGROUND

The invention is described with reference to an apparatus for filling containers, in particular with a beverage. However, it is to be noted that the apparatus according to the disclosure can also be applied to other systems for treating containers, such as for example sterilising machines and the like.

In many areas it is necessary for the containers to be treated, for example filled, in a clean room or a sterile room. To this end, the containers are introduced into said clean room so as to be treated there under sterile conditions. One problem with this treatment is here the maintenance of the sterile ambient conditions, in particular if the wall areas of this treatment chamber are movable relative to each other.

WO 2007/132339 A1 describes an apparatus for treating containers which are filled with liquids or particulate products. Here, a carousel on which the treatment elements are arranged is provided. These treatment elements are provided here within an enclosed space. WO 2009/130656 A1 describes an installation structure for containers, packaging machines and in particular for container closing mechanisms. Here, also an isolating housing is provided which extends around a conveyor unit.

GB 628,530 also describes filling systems. Here, also rotatable holders for the bottles as well as means for filling and closing the containers are provided.

From DE 2139 057, an apparatus for the aseptic conditioning of any products, in particular of foodstuffs, is known. Here, this apparatus includes a space which is sealed against the external atmosphere, the bottom of said space being formed by a plate, with metering and distributing devices being mounted below this plate and the edges of an opening of the plate forming a rotatable, sealed connection, through which an emptying device can enter so as to be fastened to a distribution device.

DE 603 11 011 T2 describes a machine for the aseptic treatment of containers in a filling system. Here, also sealing means for isolating a non-sterile area of the machine from an area that is kept under sterile conditions is provided, said means comprising at least one stationary annular channel that is at least partially filled with a liquid, in which a concentric annular element associated with the rotary part slides.

DE 10 2006 007 367 A1 describes a sealing arrangement for sealing a transition between a circulating and a stationary machine element, as well as a system or device for treating bottles and similar containers with at least one such sealing arrangement. Here, at least one discharge opening or nozzle for a cleaning and/or sterilisation agent is provided on the sealing arrangement for cleaning and/or sterilising said sealing arrangement.

DE 10 2006 007 481 B3 discloses a system for the cold-aseptic filling of a liquid product into bottles or similar containers. Here, the containers are moved on a conveyor section through at least one container treatment machine in a sterile room which is separated by an enclosure from at least one non-sterile room. The enclosure is formed by at least a circulating and at least a stationary part. A syphon seal is provided at the transition between the two parts.

Hydraulic sealing systems are known from the prior art in particular from the above-mentioned DE 10 2006 007 367 and DE 603 11 011. They are particularly used for container treatment machines which preferably have a stationary and a circulating rotary machine part, in which for example plastic containers are transported by their neck ring. However, it is especially containers with different container heights which often cause difficulties. Particular difficulties occur when such containers are guided on the respective container bottoms, because in this case the container mouths are at different levels and therefore the distance for example of individual filling mechanisms with regard to the carrying surface of the containers has to be modified. This is a particular problem in the case of for example plastic containers without a neck ring, because these need a support surface on the container bottom, so that they can be transported through the container treatment machine.

SUMMARY

According to various aspects of the disclosure, an apparatus for treating containers comprises a treatment chamber in which the containers are treated. Further, the apparatus comprises a conveyor unit that conveys the containers within the treatment chamber, said treatment chamber being isolatable or isolated from an environment of the treatment chamber by at least one wall in such a way that sterile conditions can be achieved in the treatment chamber. Further, at least one treatment unit is provided which treats the containers within the treatment chamber, with at least one wall of the treatment chamber being arranged to be movable. Finally, sealing means are provided in order to seal the treatment chamber in an area in relation to elements which are movable relative to each other and in particular walls of the apparatus against the environment of the treatment chamber.

According to the disclosure, the sealing means include a surrounding channel, into which a liquid sealing agent can be introduced, and a wall disposed within this channel at least in sections, which wall is movable relative to the channel in the circumferential direction of said channel and which wall is movable in a direction that is perpendicular to the circumferential direction. In some aspects, a movement of this wall in the direction that is perpendicular to the circumferential direction causes a change of the size of the treatment chamber.

Thus, there are preferably sterile conditions within the treatment chamber, which are maintained by virtue of the fact that the treatment chamber is sealed against the environment. The treatment unit may be any unit that treats the containers, such as in particular a filling unit, but also sterilising units, flushing units, heating/cooling units and the like as well as container closing units or even labelling units and other container equipment units. With regard to filling units, there are no restrictions with regard to the filling system (volumetric, mass-based, filling to a certain level etc.) or product to be filled (still/carbonated etc.).

Here, in some aspects, at least one of those walls can be moved which isolates the treatment chamber from its environment. The sealing means are provided in order to maintain a seal between the treatment chamber and the external space in the region in which two areas of the treatment chamber, which are movable relative to each other, are provided. In some aspects, therefore, the treatment chamber has at least two walls which are movable relative to each other.

The seal is achieved here by means of the fact that the wall can be submersed particularly at any time into the sealing agent present in the channel, and whilst in this way a relative movement of the wall relative to the passage is still possible, however, particularly gaseous media cannot escape from the treatment chamber to the outside and can in particular not enter from the outside into the treatment chamber. In some aspects, the channel is an annular channel that is arranged, for example, concentrically with regard to a rotary axis of the conveyor unit.

In the prior art, such sealing means which are also referred to as surge tanks, are already being used. In the case of the sealing means according to the disclosure, however, not only a relative movement in the circumferential direction of the passage, but also a movement perpendicular thereto is possible. This means that the wall and in some aspects together with this also part of the apparatus is height-adjustable. As a result of this height-adjustability, the apparatus may be adapted to various container heights.

In some aspects, the conveyor unit is formed in such a way that it guides the containers in an area that is located at a distance from the mouth of the containers. Usually, containers such as for example PET bottles are guided by their support ring that is located below the mouth. In the case of this embodiment, however, the containers are conveyed by a different area, in particular by the bottom of the containers. This means that the conveyor unit contacts the container at least also at the bottom thereof. For containers, in particular plastic containers without such a support ring, usually a support surface on the container bottom is needed, so that they can be conveyed through the container treatment machine. Thus, it is for example possible for the containers to be supported during transport at the bottom of the container and are for example clamped in the area below the mouth. However, it would also be possible for the containers to be guided in the area of their circumferential wall. If such a system provides for the containers to be conveyed by the bottom thereof and the product is changed, the height-adjustment means according to the disclosure allow different container sizes with different heights H to be used upon such a product change.

In various aspects, the apparatus is a filling unit which fills a medium, in particular a beverage, into the containers. Here, the apparatus may have a plurality of filling elements which fill the medium into the containers. However, also other apparatus such as for example sterilisation units or rinsers may be considered. Any media used on the treatment units may be carried from the stationary base part of the machine to the rotary top part of the machine via a media distribution unit. For example, in some aspects, this media distribution unit includes at least one hollow shaft.

It is possible here for the largest part of the filling elements to be arranged outside of the sterile room and merely an opening that is located at the mouth of the container to be positioned within the sterile room. In some aspects, the apparatus has cover means in order to cover the filling elements. Such cover means are also referred to in the prior art as CIP caps and are in particular used for covering filling elements during a flushing operation.

In a further exemplary embodiment, the conveyor unit includes a drive unit that is, in some aspects, located outside of the sterile room. In some aspects, the drive unit is used for driving a carrier wheel or a star, on which the containers are guided along a path that is circular in sections. According to various aspects, the containers are transported continuously and, in some aspects, the containers are filled with the beverage during transport. In some aspects, the individual filling means therefore move together with the conveyor unit or the movements are coupled with each other.

This carrier wheel, on which the conveyor units are arranged, may be rotatably supported via a shaft, particularly a central shaft, by means of a four-point contact bearing (spherical rotary connection).

In some aspects, the channel is arranged above a level of movement of the containers. In some aspects, a bottom edge of the channel is arranged above the level of movement of the containers. In this way it is possible to feed the containers more easily to the apparatus or to the treatment chamber, without the containers colliding with the channel in the process. In various aspects, the channel is arranged to be stationary and the wall disposed within the channel is movable relative thereto.

In a further exemplary embodiment, the apparatus includes a drive unit in order to move the wall in the direction that is perpendicular to the circumferential direction. This drive unit, too, is preferably arranged here outside of the treatment chamber. The drive unit may for example be a spindle drive. Further, in some aspects bellows are provided which are part of the drive unit and which are used to protect the drive unit for example from cleaning agents.

In a further exemplary embodiment, the apparatus includes a cleaning unit for cleaning the treatment chamber. This may in particular be a cleaning unit including a spray nozzle system which is particularly used to treat the walls of the treatment chamber with a cleaning and disinfecting agent.

This cleaning means may also be used for cleaning the walls of said channel.

In some aspects, the apparatus has a filling level detecting device for detecting a filling level of a liquid medium present in the channel. According to various aspects, water (if needed, enriched with a disinfecting agent) may be present in said channel and the filling level detecting device checks the filling level of the water, in order to prevent on the one hand a spilling over of the channel and to ensure on the other hand that said wall is permanently submersed in the water during operation. Since the wall also moves at a level of the channel, no fixed-height filling level detecting device is provided, but in some aspects a measuring probe which not only detects a limit value of the filling level, but which can specifically detect the filling level.

The present disclosure is further related to a method for treating containers, wherein the containers are guided by a conveyor unit within a treatment chamber, and this treatment chamber is isolated from the environment by means of at least one wall and in some aspects by means of at least two walls in such a way that sterile conditions are achieved in the treatment chamber. Further, at least one wall of the treatment chamber is movable relative to a further area of the treatment chamber, and by means of a first one sealing means, at least the treatment chamber is sealed in an area with regard to elements of the apparatus, which are movable relative to each other, against the environment of the treatment chamber.

According to the disclosure, the first sealing means include a surrounding channel, within which a wall is moved, and a position of this wall is at least temporarily modified in a direction that is perpendicular to the circumferential direction of the channel. In some aspects, this height modification is carried out in order to adapt the apparatus to different container heights. In some aspects, the containers are transported or guided by the bottom thereof.

Further exemplary embodiments and advantages may be evident from the accompanying drawings.

DETAILED DESCRIPTION

Figure 1:
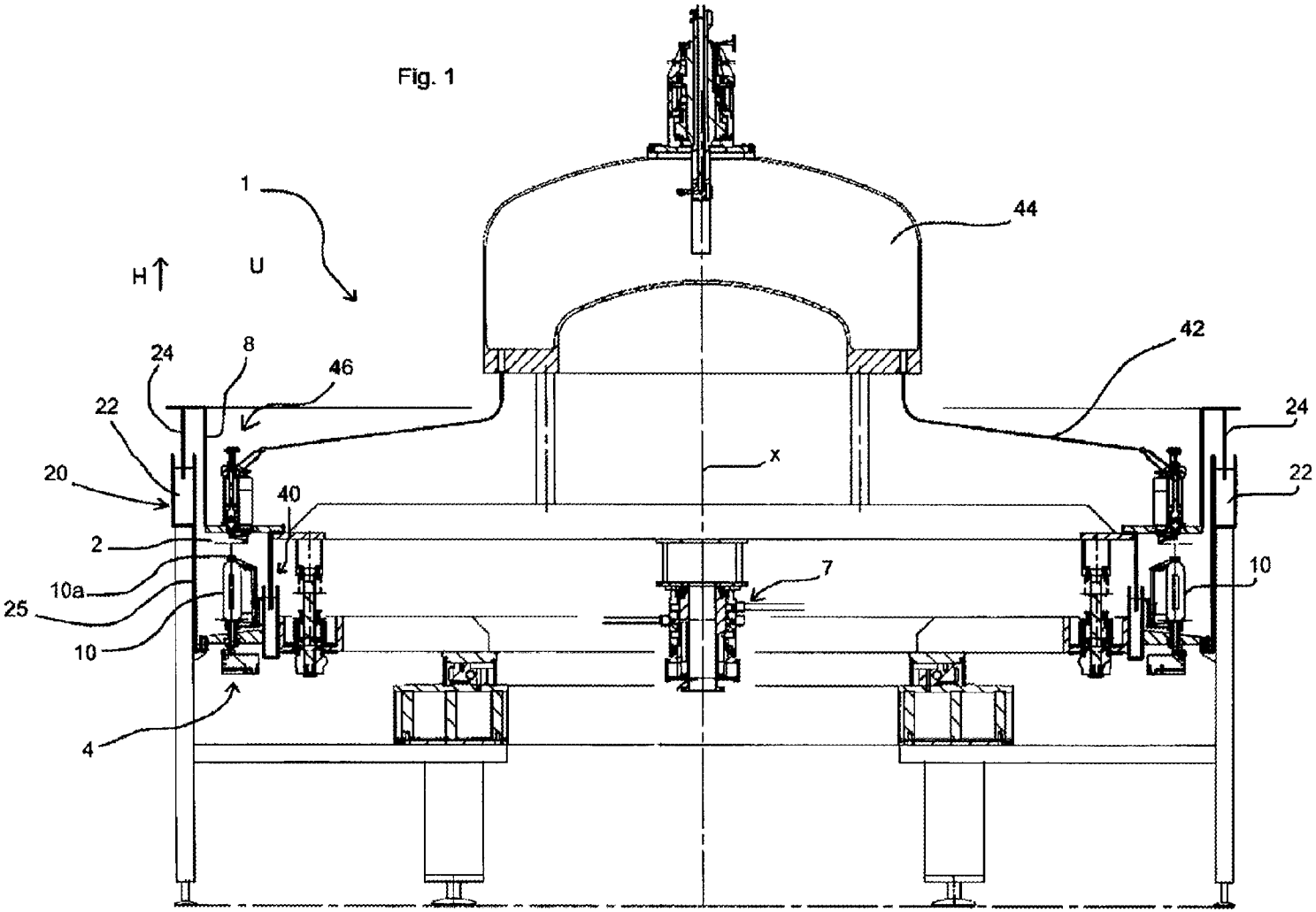
FIG. 1 shows a sectional view of an exemplary apparatus according to various aspects of the disclosure for treating containers.

FIG. 1 shows an apparatus 1 according to the disclosure for treating containers 10, more specifically for filling containers 10. This apparatus comprises a rotatably arranged liquid reservoir 44, in which the beverage to be filled in is located. Liquid is supplied via liquid lines 42 to the individual filling elements 46, which are also arranged to be rotatable in relation to the rotary axis X shown here. Here, a plurality of such filling elements 46 is arranged at equal distances relative to each other in the circumferential direction, as a result of which the containers 10 can be filled in a continuous flow. Media such as for example the beverage to be filled in can be delivered from the stationary base part of the apparatus to the rotary top part of the apparatus via a media distribution unit 7. Lines (not shown) for additional media, such as for example electric current or pressurized air, may be guided through a hollow shaft. The top part of the apparatus is supported on a bearing 9 and can be rotated by means of drives (not shown). As a bearing 9, for example, a so-called ball bearing slew ring, i.e. a four-point contact support, is used. Of course, also other bearing types as known to a person skilled in the art may be used.

Reference numeral 20 generally identifies first sealing means for sealing a clean room or treatment chamber 2 against the environment U. These first sealing means 20 include here an annular channel 22 in which the liquid is present. This annular channel is arranged to be stationary.

With regard to the annular channel 22, a wall 24 moves in the circumferential direction and thus constitutes a movable wall of the treatment chamber 2. The wall 8, too, is movable. The wall 24 is here continuously submersed below the liquid surface of the liquid present in the channel 22 during the filling operation. The wall 25 constitutes a wall arranged to be stationary, which also isolates the treatment chamber 2 from the environment U. Reference numeral 10 relates to a container having a mouth 10*a*. Reference numeral 4 generally identifies here the conveyor unit which moves the containers along the circular path together with filling elements 46.

Figure 2:
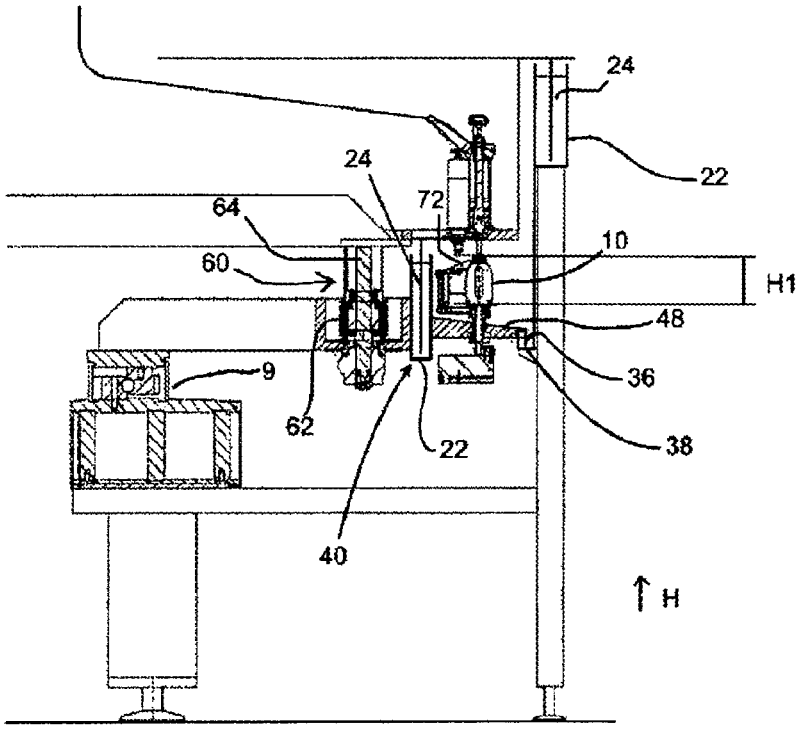
FIG. 2 shows a partial view of the apparatus from FIG. 1 in a first operating condition.

FIG. 2 shows a detailed view of the apparatus of FIG. 1, more specifically the right-hand part of the apparatus of FIG. 1 in a first operating condition. In this operating condition, comparatively short containers 10 (having a height H1) are filled. What can be seen here are second sealing means 40 which also include a (stationary) channel 22 and a wall 24 to be submersed (movable) therein and which is used for the purpose of sealing the treatment chamber 2 towards the inside. On a carrier plate 48, which is part of the conveyor unit 4, the individual containers 10 are held or carried. Reference numeral 72 identifies a further holding device by which the container 10 is supported in the upper area thereof.

Reference numeral 38 identifies a further annular channel and reference numeral 36 a wall which is again movable and which is submersed in said channel. This channel does not necessarily have to be implemented here at the same level as the two channels 22, because the carrier 48 is not moved in the case of a height adjustment. This means that the wall 36 does not move in the height direction H in relation to the channel.

If now a change to larger or higher containers 10 (height H2) is carried out, the upper area of the plant is lifted upwards, i.e. the two walls 24 as well as for example the filling elements 46 and the feed lines 42 move upwards. In this way, the walls 24 will move further upwards, but only so far so as to be still immersed in the liquid in the annular channel 22.

Reference numeral 60 relates to a drive which here realises the height adjustment. In this embodiment, this drive includes a rotary spindle 64 which engages in a corresponding nut and in this way moves the filling elements 46 and the other height-adjustable parts upwards during rotation. Reference numeral 62 relates here to bellows surrounding this spindle, which are expanded or contracted as a function of the height position whilst maintaining their sealing effect against the environment.

Figure 3:
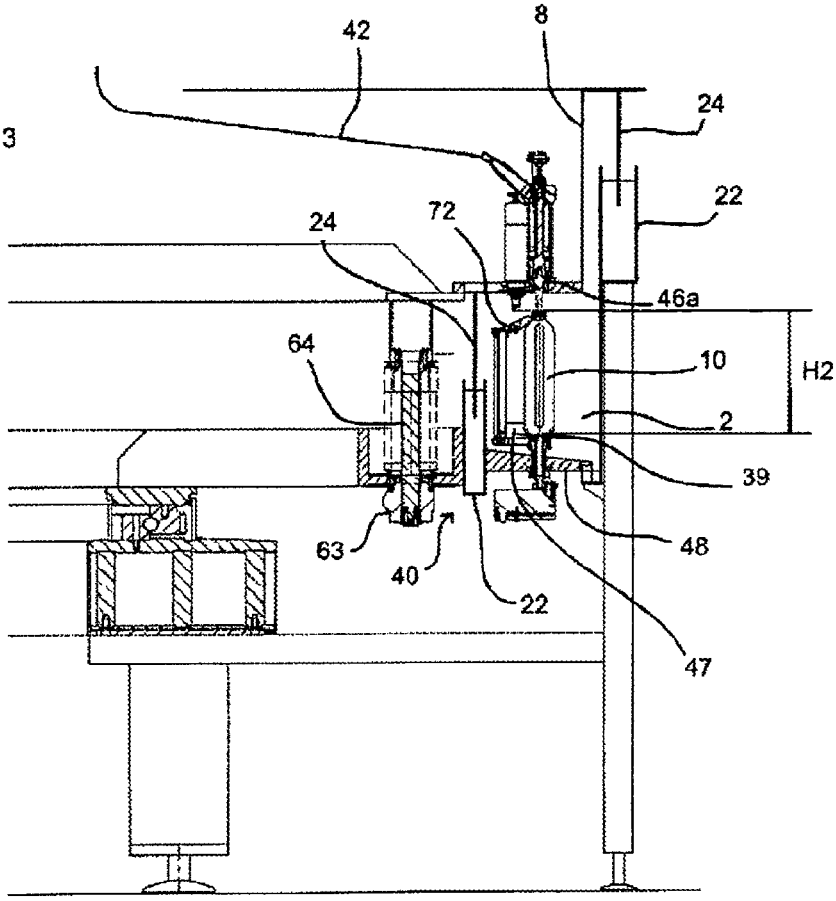
FIG. 3 shows the apparatus from FIG. 1 in a second operating condition.

Thus, FIGS. 2 and 3 show by way of example how the containers can be positioned in the apparatus. The containers having a certain height stand on a plate 39. The containers are fed to the apparatus 1 by a feeding device (not shown). One possibility of how such containers can be transported through several treatment stations can be seen for example from DE 69 937 227 T2, the disclosure of which is included here in its entirety as part of the disclosure of the present invention.

As explained above, in the embodiment shown here the container is positioned below the respective filling valves 46*a* by fixing means or holding means 72. Moreover, pushing beyond the desired position may be prevented by means of a metal sheet 47. The drive 60 for adjusting the height is additionally equipped with one or more transmissions 63 having a drive which, as mentioned above, have associated therewith the spindle 64 with the bellows 62. The containers 10 shown in the figures usually have a height in a range between 120 and 350 mm.

Figure 4:
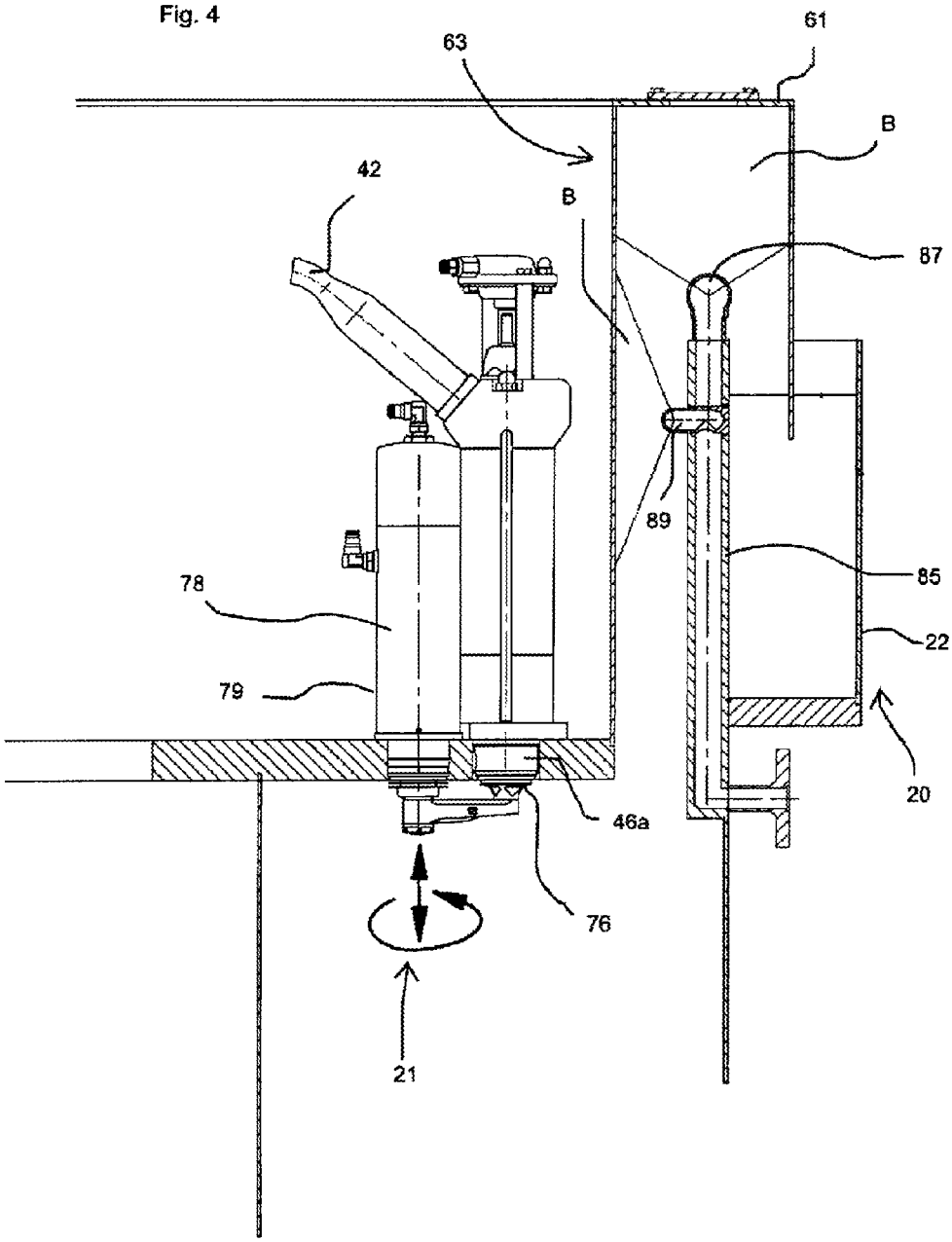
FIG. 4 shows a detailed view of the apparatus of FIG. 1 for illustrating a cleaning mechanism.

FIG. 4 illustrates the cleaning of the first sealing means 20. During the cleaning operation, a CIP cap 76 is pivoted in, so that the inside of the filling valve 46*a* is sealed. During this process, this CIP cap 76 is operated by means of a pneumatic cylinder 78 which carries out the lifting and pivoting movement 21 within a housing 79.

One or several spray nozzles 87, 89 may be arranged on a cleaning strip 85. These spray nozzles may advantageously be spray balls. These spray nozzles 87, 89 should be arranged here in such a way that their spray patterns or zones B overlap. However, this can also be ensured by means of extending and retracting the height adjustment unit as shown in FIGS. 2 and 3.

If, in addition, the treatment apparatus is rotated, the entire surface of the frame 8 and the upper metal sheet 61 can be cleaned.

By suitably positioning further spray nozzles, all of the surfaces of the treatment chamber 2 can be cleaned in this way. The cleaning system may be advantageously implemented in such a way that spray nozzles are arranged on the stationary part of the treatment machines and clean the rotating surfaces of the clean room and inversely, spray nozzles on the rotating part of the surfaces also clean the surfaces of the stationary part of the machine, wherein said rotary cleaning system can be supplied by means of a media distribution unit 7 (see FIG. 1). In some aspects, lyes or acids are used for cleaning. In a final step, a flushing operation using fresh or sterile water is usually carried out.

During this operation it would be possible that no or only little liquid is present in the channels 22, 38. Instead, a germicidal liquid such as e.g. peracetic acid may be used.

Figure 5:
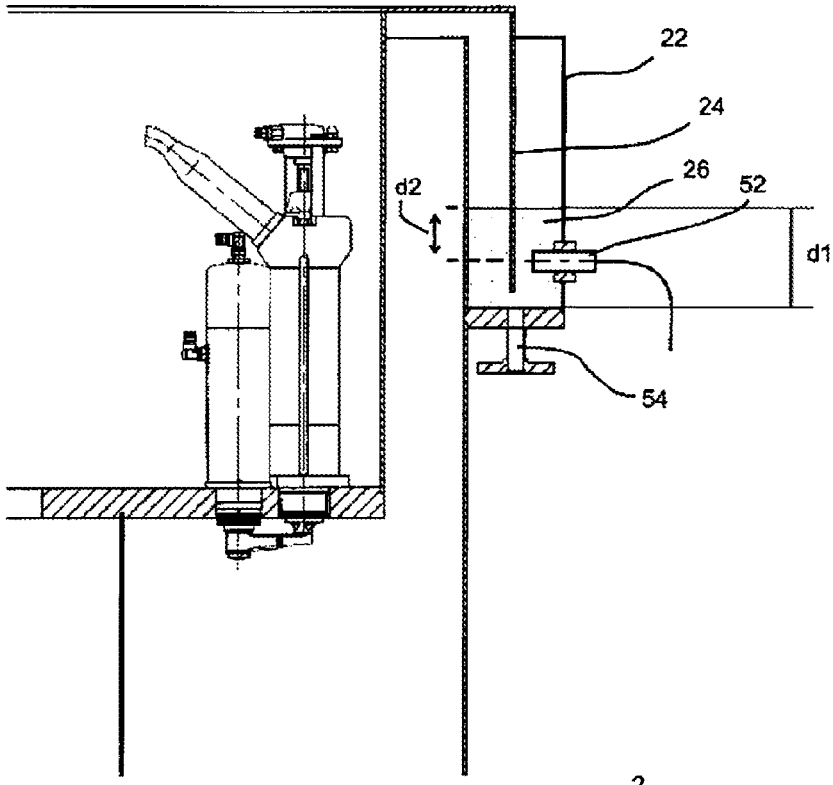
FIG. 5 shows a further detailed view of the apparatus of FIG. 1.
Figure 6:
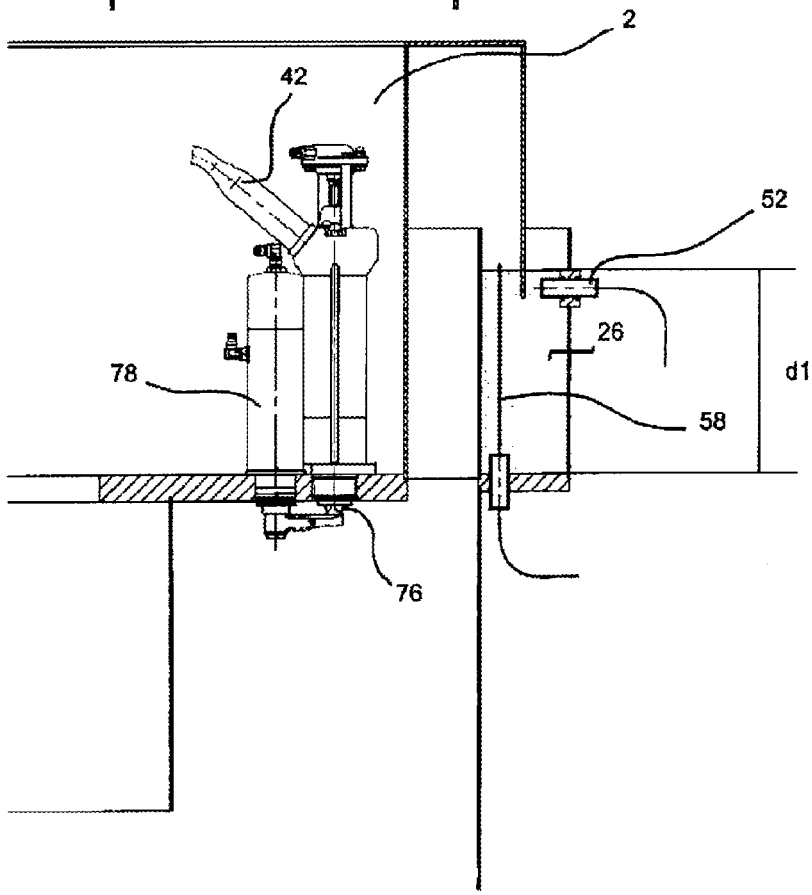
FIG. 6 shows a further detailed view of the apparatus of FIG. 1.

It will now be illustrated with reference to FIGS. 5 and 6 how the cleaning system described above can also be used to carry out a clean room sterilisation process. In this case, either a liquid or a gaseous sterilisation medium can be supplied through the pipe system. If gaseous sterilisation is applied, it may be advantageous if the hydraulic sealing means, i.e. channels 22 and 38, are filled so as not to adversely affect the environment or to cause any risk to operating personnel. FIG. 5 illustrates, by way of example, the filling of the annular channel 22. Liquid is fed into the annular channel 22 via at least one feed line 54. When the liquid reaches a liquid level detector 52, a timer is started and the liquid level detector 52 is overfilled by the specified level d2. If the overall level d1 (e.g. as a result of evaporation) falls below the level of the switch or filling level detector 52, overfilling is restarted. In this way it can be achieved that the (in particular annular) wall 24 is always submersed in the liquid 26.

This control as shown is well suited for hydraulic sealing systems without height adjustment means and is under certain conditions also suitable for sealing devices equipped with height adjustment means. However, as can be seen from FIG. 6, the filling level limit switch 52 has to be located at a high level for relatively high containers because otherwise underfilling can no longer be reliably detected by the filling level switch 52. As a result, channel 22 will have to be filled up to the level d1 as shown in FIG. 6 in any position of the height adjustment means 60 (see FIGS. 2 and 3).

In this way, however, the consumption of liquid 26 for filling is increased and the risk of spilling over with the wall 24 submersed is also increased. It may therefore be advantageous to provide a control by means of a filling level probe 58, since the level d1 can be adjusted to the position of the height adjustment unit 60. In addition, a filling level switch 52 may be used as a safety device for overfilling or overflow, if, for example, the probe 58 is defective. In some aspects, several discharges 54 for emptying are provided on the channel 22.

It will be apparent to those skilled in the art that various modifications and variations can be made to the apparatus for treating containers of the present disclosure without departing from the scope of the invention. Throughout the disclosure, use of the terms "a," "an," and "the" may include one or more of the elements to which they refer. Other embodiments of the invention will be apparent to those skilled in the art from consideration of the specification and practice of the invention disclosed herein. It is intended that the specification and examples be considered as exemplary only.

What is claimed is:

1. An apparatus for treating containers, comprising:

a treatment chamber in which containers are treated;

a conveyor unit which transports the containers within the treatment chamber;

at least one wall arranged to isolate the treatment chamber from an environment external of the treatment chamber in such a way that sterile conditions are achievable in the treatment chamber, said at least one wall arranged to be movable;

at least one treatment unit which treats the containers within the treatment chamber; and sealing means configured to seal the treatment chamber in an area with regard to elements of the apparatus, which are movable relative to each other, against the environment external of the treatment chamber, the sealing means including a surrounding channel into which a liquid sealing agent is introduced, and an additional wall which is arranged within said channel at least in sections, said additional wall being movable relative to the channel in the circumferential direction of the channel, the additional wall being movable in a direction that is perpendicular to the circumferential direction.

2. The device as claimed in claim 1, wherein the conveyor unit is formed in such a way that it guides the containers in an area located at a distance from the mouth of the containers.

3. The apparatus as claimed in claim 1, wherein the apparatus is a filling unit which fills the containers with a medium.

4. The apparatus as claimed in claim 3, wherein the apparatus has a plurality of filling elements which fill the containers with the medium.

5. The apparatus as claimed in claim 1, wherein the apparatus has second sealing means in order to seal the treatment chamber in an area of elements of the apparatus, which are movable relative to each other, against the environment of the treatment chamber.

6. The apparatus as claimed in claim 1, wherein a drive unit of the conveyor unit is arranged outside of the treatment chamber.

7. The apparatus as claimed in claim 1, wherein the channel is located above a movement level of the containers.

8. The apparatus as claimed in claim 1, wherein the apparatus includes a drive unit in order to move the additional wall in the direction that is perpendicular to the circumferential direction and that this drive unit is arranged outside of the treatment chamber.

9. The apparatus as claimed in claim 1, wherein the apparatus includes a filling level detection device, in order to detect a filling level of a medium present in the channel.

10. An apparatus for treating containers, comprising:

a treatment chamber in which containers are treated;

at least one treatment unit configured to treat the containers within the treatment chamber, the at least one treatment unit being rotatable about an axis;

a conveyor unit configured to transport the containers within the treatment chamber, the conveyor unit including a carrier plate configured to carry containers thereon, the carrier plate being movable relative to said at least one treatment unit in a direction of said axis;

a first wall arranged to isolate the treatment chamber from an environment external of the treatment chamber in such a way that sterile conditions are achievable in the treatment chamber, the first wall being rotatable with said at least one treatment unit and being movable in the direction of said axis; and a sealing assembly configured to seal the treatment chamber in an area with regard to elements of the apparatus, which are movable relative to each other, against the environment external of the treatment chamber, the sealing assembly including a stationary annular channel into which a liquid sealing agent is introduced, and a second wall arranged within said channel at least in sections, the second wall being movable relative to the channel in the circumferential direction of the channel and being movable in a direction that is perpendicular to the circumferential direction.

11. The device as claimed in claim 10, wherein the conveyor unit is formed in such a way that it guides the containers in an area located at a distance from the mouth of the containers.

12. The apparatus as claimed in claim 10, further comprising a second sealing assembly in order to seal the treatment chamber in an area of elements of the apparatus, which are movable relative to each other, against the environment external of the treatment chamber.

13. The apparatus as claimed in claim 10, wherein the conveyor unit includes a drive unit arranged outside of the treatment chamber.

14. The apparatus as claimed in claim 10, wherein the channel is located above a movement level of the containers.

15. The apparatus as claimed in claim 10, further comprising a drive unit configured to move the second wall in the direction that is perpendicular to the circumferential direction, the drive unit being arranged outside of the treatment chamber.

16. An apparatus for treating containers, comprising:

a treatment chamber in which containers are treated;

a conveyor unit which transports the containers within the treatment chamber;

at least one wall arranged to isolate the treatment chamber from an environment external of the treatment chamber in such a way that sterile conditions are achievable in the treatment chamber;

at least one treatment unit which treats the containers within the treatment chamber;

at least one wall of the treatment chamber arranged to be movable;

a first sealing assembly configured to seal the treatment chamber in an area with regard to elements of the apparatus, which are movable relative to each other, against the environment external of the treatment chamber, the first sealing assembly including a surrounding channel into which a liquid sealing agent is introduced, and an additional wall which is arranged within said channel at least in sections, said additional wall being movable relative to the channel in the circumferential direction of the channel, the additional wall being movable in a direction that is perpendicular to the circumferential direction; and a second sealing assembly configured to seal the treatment chamber in an area with regard to elements of the apparatus, which are movable relative to each other, against the environment of the treatment chamber, wherein the first sealing assembly and the second sealing assembly are on opposite sides of the treatment chamber.

17. The apparatus as claimed in claim 16, wherein the at least one treatment unit is a filling unit which fills the containers with a medium.

18. The apparatus as claimed in claim 17, wherein the at least one treatment unit includes a plurality of filling elements which fill the containers with the medium.

19. The apparatus as claimed in claim 16, further comprising a filling level detection device configured to detect a filling level of a medium present in the channel.

20. A method for treating containers, comprising:

providing the apparatus of claim 1;

guiding containers within a treatment chamber by means of a conveyor unit;

isolating said treatment chamber from an environment external to the treatment chamber by means of at least one wall such that sterile conditions are achievable in the treatment chamber;

moving at least one wall of the treatment chamber relative to a further area of the treatment chamber; and sealing said treatment chamber by means of first sealing means in an area of elements of the apparatus, which are movable relative to each other, against the environment external of the treatment chamber, said sealing step including moving an additional wall within a surrounding circumferential channel of the first sealing means, and modifying a position of said additional wall, at least temporarily, in a direction that is perpendicular to the circumferential direction of the channel.

* * * * *